US006003206A

United States Patent [19]

Hall et al.

[11] Patent Number: 6,003,206

[45] Date of Patent: Dec. 21, 1999

[54] CONTROL KNOB USING LED FOR BACKLIGHTING

[75] Inventors: Michael J. Hall, Manhattan; Brian J. Truesdale, Plainfield; T.M. Narasimhan, Westmont, all of Ill.

[73] Assignee: Illinois Tool Works Inc., Glenview, Ill.

[21] Appl. No.: 09/078,475

[22] Filed: May 14, 1998

[51] Int. Cl.[6] ..... A47B 95/02

[52] U.S. Cl. ..... 16/441; 16/433; 16/903; 362/26

[58] Field of Search ..... 16/121; 116/200, 116/202, 286, 284, DIG. 36, DIG. 5, DIG. 26; 362/29, 86, 30, 31, 26

[56] References Cited

U.S. PATENT DOCUMENTS

| | | | |
|---|---|---|---|
| 5,111,007 | 5/1992 | Miller et al. | 116/286 |
| 5,171,080 | 12/1992 | Bathurst | 362/26 |
| 5,335,148 | 8/1994 | Tominaga | 362/26 |
| 5,450,653 | 9/1995 | Howie, Jr. | 16/121 |
| 5,695,269 | 12/1997 | Lippmann et al. | 362/31 |
| 5,697,689 | 12/1997 | Levine et al. | 362/26 |
| 5,752,759 | 5/1998 | Pizzo | 362/26 |

*Primary Examiner*—Chuck Y. Mah
*Attorney, Agent, or Firm*—Kane, Dalsimer, Sullivan and Levy, LLP

[57] ABSTRACT

The control knob engages, on its interior, a translucent polycarbonate jewel body collar assembly of a first color, such as white, which, in turn, provides a housing for a translucent polycarbonate jewel LED holder assembly. The LED emits light, possibly modified by the jewel LED holder assembly, of a second color, such as blue or blue-green. This second color can be varied in intensity and hue by varying the polarity and resistance of the LED. The jewel body collar assembly includes a collar to engage the interior cylindrical support section of the control knob and a housing assembly to engage the jewel LED holder assembly. The jewel body collar assembly further includes a ridge which protrudes through a slot in the sidewall and front face of the control knob thereby forming an indicator for the control knob. In ambient illumination, such as during the day, the indicator appears to be the color of the jewel body collar assembly, such as white. However, when the LED is electrically illuminated, such as during the night, the illumination passes through the jewel LED holder assembly, and the resulting color, such as blue or blue-green, is projected through the ridge of the jewel body collar assembly and the indicator appears to be blue or blue-green. An alternative embodiment mounts the LED on a mount assembly which is fastened to the control shaft and which extends into the interior of the control knob.

8 Claims, 8 Drawing Sheets

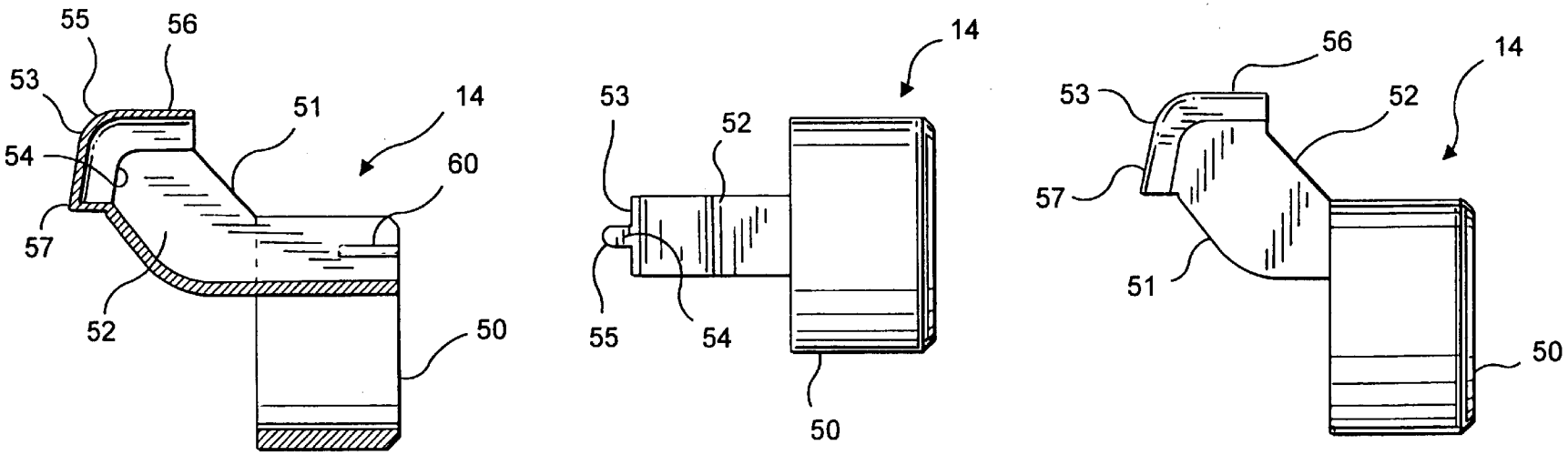
FIG. 6c
FIG. 6b
FIG. 6a
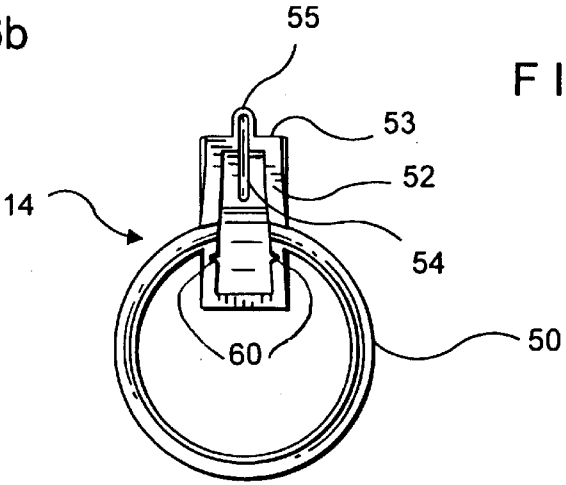
FIG. 6e
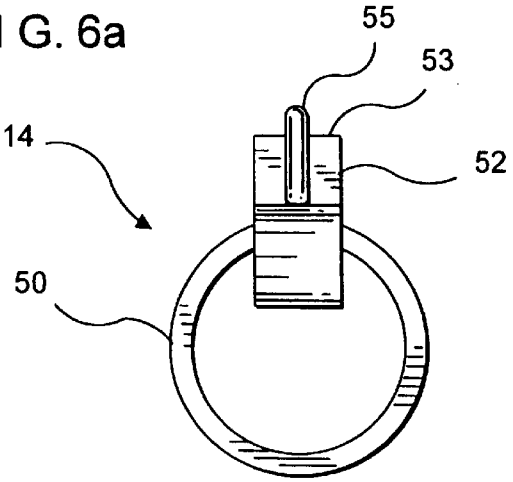
FIG. 6d

CONTROL KNOB USING LED FOR BACKLIGHTING

BACKGROUND OF INVENTION

1. Field of Invention

This invention pertains to a control knob, particularly for automotive applications, with an indicator portion which remains a first color, such as white, during the day, but which appears illuminated at night to a second color, such as blue, the second color being variable as to both hue and intensity. An LED (light emitting diode) is included within the control knob, secured either to the control knob or the control shaft, to provide illumination to the indicator portion during the night.

2. Description of the Prior Art

In the prior art, control knobs, particularly control knobs in automotive applications, have had position indicators for indicating the rotational position of the knob. While paints and inks have frequently been used to provide such an indicator, this solution has not been resistant to abrasion. U.S. Pat. No. 5,450,653 entitled "Composite Knob with an Insertable Position Indicator" issued on Sep. 19, 1995 to Howie, Jr. discloses a composite knob with an insertable position indicator which would be more resistant to abrasion than simple paints or inks. The position indicator has a color contrasting to that of the knob. However, this indicator does not provide a first color, such as white, during the daytime, and a second distinct color, such as blue, during the nighttime.

U.S. Pat. No. 5,050,269 entitled "Control Knob" issued on Sep. 24, 1991 to Engstrom et al. discloses a control knob, apparently for a portable telephone or "walky-talky" type device, with an outer portion of reduced hardness molded over an inner portion with a blade portion extending through the outer portion to provide an indicator. This does not appear to provide for different colors of the indicator during daytime and nighttime.

U.S. Pat. No. 5,518,561 entitled "True Color Day-Night Graphics and Method of Assembly issued on May 21, 1996 to Rosa discloses a display panel with a light-emitting electroluminescent portion, but does not relate to control knobs, particularly for automotive applications.

Additionally, in the prior art, it has been a concern for the control knob indicator portion to be adequately illuminated during the nighttime. This has been of a particular concern for incandescent illumination, which generates considerable heat.

Similarly, in the prior art, the control knob indicator portions have not included entirely satisfactory methods for controlling both the brightness and color of the indicator portion of a control knob.

Additionally, in the prior art, it has been a substantial concern that the knobs not wobble in use, as this may be disconcerting to the user.

Other references of interest include U.S. Pat. No. 5,469,758 issued on Nov. 28, 1995 to Howie, Jr.; U.S. Pat. No. 5,259,267 issued on Nov. 9, 1993 to Jurewicz; U.S. Pat. No. 5,303,612 issued on Apr. 19, 1994 to Odom et al. ; U.S. Pat. No. 2,753,911 issued on Jul. 10, 1956 to Haslett; and U.S. Pat. No. 273,685 issued on Mar. 6, 1883 to Huntley.

Additionally, the following applications were filed on behalf of the present assignee and the disclosures of which are hereby incorporated by reference—U.S. patent application Ser. No. 08/746,989 entitled "Control Knob" was filed on Nov. 19, 1996, U.S. patent application Ser. No. 08/812,576 entitled "Illuminated Knob Assembly" was filed on Mar. 7, 1997, and U.S. patent application Ser. No. 09/048,770 entitled "Illuminated Knob Assembly" was filed on Mar. 26, 1998.

OBJECTS AND SUMMARY OF THE INVENTION

It is therefore an object of this invention to provide a reliable indicator for a control knob, particularly for automotive applications.

It is therefore a further object of this invention to provide an indicator for a control knob, the indicator being a first color, such as white, during the day, and a second color, such as blue, during the night when illuminated.

It is therefore a further object of this invention to provide an indicator for a control knob, wherein the second color described above can be varied in both hue and brightness.

It is therefore a further object of this invention to provide an indicator for a control knob, particularly for automotive applications, which is simple and inexpensive to construct and install.

It is therefore a further object of this invention to provide a control knob, particularly for automotive applications, with reduced side-to-side wobble.

These and other objects are attained in the first embodiment by a control knob which includes a jewel body collar assembly into which a jewel LED holder assembly is inserted. The jewel body collar assembly includes a portion which extends or protrudes through a slot in the cylindrical sidewalls of the control and in a portion of the front of the control knob to form the indicator. Additionally, the jewel body collar assembly includes a cylindrical collar which engages the interior cylindrical portion of the knob which engages the carrier shaft thereby forming a bearing surface against the mating bezel thereby reducing side-to-side wobble of the knob during use. As the jewel body collar assembly is made of a lubricated material, such as acetel, this provides lubrication for the rotation of the control knob. Snap fit engagements provide for ease of assembly. The jewel body collar assembly includes a portion which extends or protrudes through a slot in the cylindrical sidewalls of the control and in a portion of the front of the control knob to form the indicator. A multi-color LED is embedded within the jewel LED holder assembly to provide illumination to the indicator during the nighttime. The LED is powered via a polymer thick film (PTF) circuit. By changing the polarity and resistance via the PTF circuit, the hue and intensity of the LED can be changed.

The jewel body collar assembly is translucent, typically white, so that the indicator appears white during daytime. However, during the nighttime, the second color is provided by the LED (as possibly modified by any color of the jewel LED holder assembly), the illumination of which passes through the jewel body collar assembly. As stated previously, the hue and intensity of the LED can be varied by varying the polarity and resistance via the PTF circuit. In particular, either the hue or the intensity of the indicator could be varied via the PTF circuit as a function of the degree of rotation of the control knob. For instance, different hues or intensities could be associated with various heater fan settings.

A typical choice for the second color would be blue, blue-green or "ice blue".

In the second embodiment of the present invention, the jewel LED holder assembly is replaced with a single translucent indicator portion, which is a first color, typically white. The jewel LED holder assembly is replaced by an LED mount which is fastened to a collar which is secured to the control shaft. The LED emits a second color, such as blue, the hue and intensity of which can be varied by the polarity and resistance from the PTF circuit. When the LED is not illuminated, the indicator portion appears as the first color, such as white. However, when the LED is illuminated, the indicator appears as the color emitted from the LED.

BRIEF DESCRIPTION OF THE DRAWINGS

Further objects and advantages of the invention will become apparent from the following description and claims, and from the accompanying drawings, wherein:

FIG. 6*a*, 6*b*, 6*c*, 6*d* and 6*e* are cross-sectional side, bottom plan, side plan, front plan and rear plan views, respectively, of the jewel body collar assembly of the first embodiment of the present invention.

DETAILED DESCRIPTION OF THE PREFERRED EMBODIMENT

The disclosures of the following are hereby incorporated by reference—U.S. patent application Ser. No. 08/746,989 entitled "Control Knob" filed on Nov. 19, 1996, U.S. patent application Ser. No. 08/812,576 entitled "Illuminated Knob Assembly" filed on Mar. 7, 1997, and U.S. patent application Ser. No. 09/048,770 entitled "Illuminated Knob Assembly" filed on Mar. 26, 1998.

Figure 1:
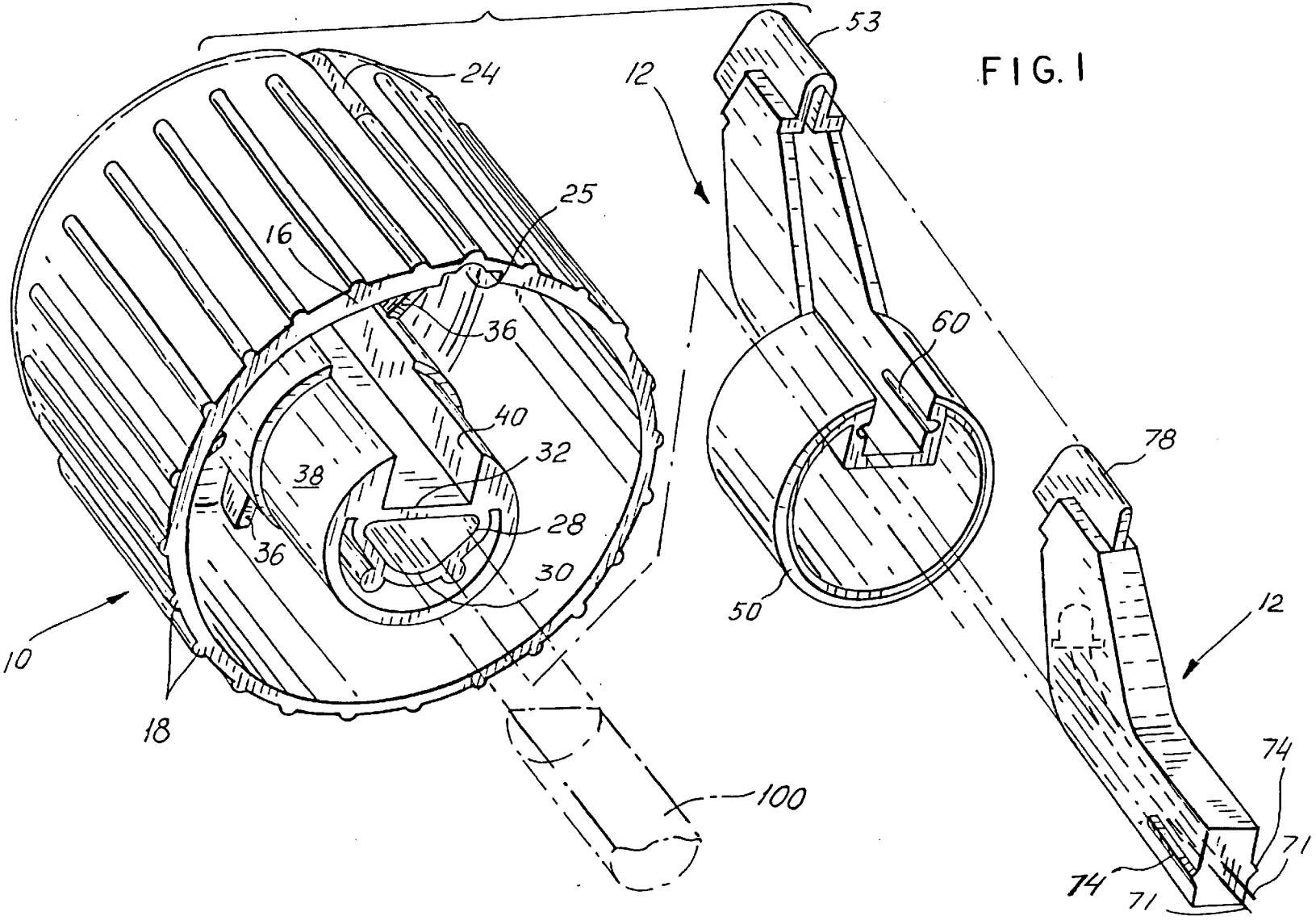
FIG. 1 is an exploded rear view, in perspective, of the control knob, the jewel LED holder assembly and the jewel body collar assembly of the first embodiment of the present invention, wherein the LED is embedded within the jewel LED holder assembly.

Referring now to the drawings in detail wherein like numerals refer to like elements throughout the several views, one sees that FIG. 1 is an exploded rear view of the control knob 10, jewel LED holder assembly 12 and jewel body collar assembly 14 of the first embodiment of the present invention. In this embodiment, LED 70 is embedded within jewel LED holder assembly 12 and powered via leads 71.

Figure 2:
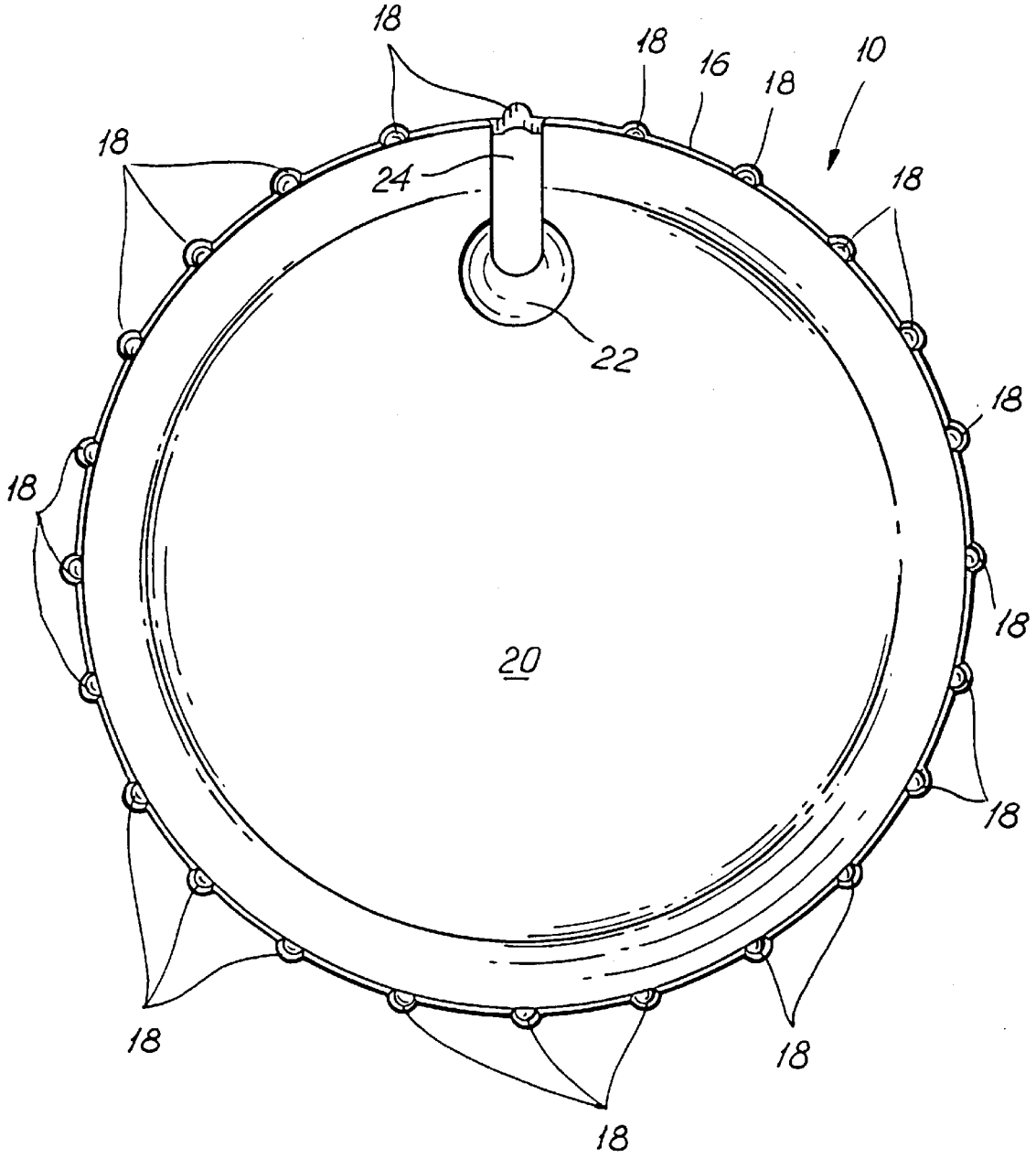
FIG. 2 is a front plan view of the control knob of the first embodiment of the present invention.

As shown in FIGS. 1 and 2, the control knob 10 includes a cylindrical shell 16 with undulations 18 spaced about the periphery thereof. Undulations 18 allow the user to grasp firmly and rotate control knob 10.

Figure 5:
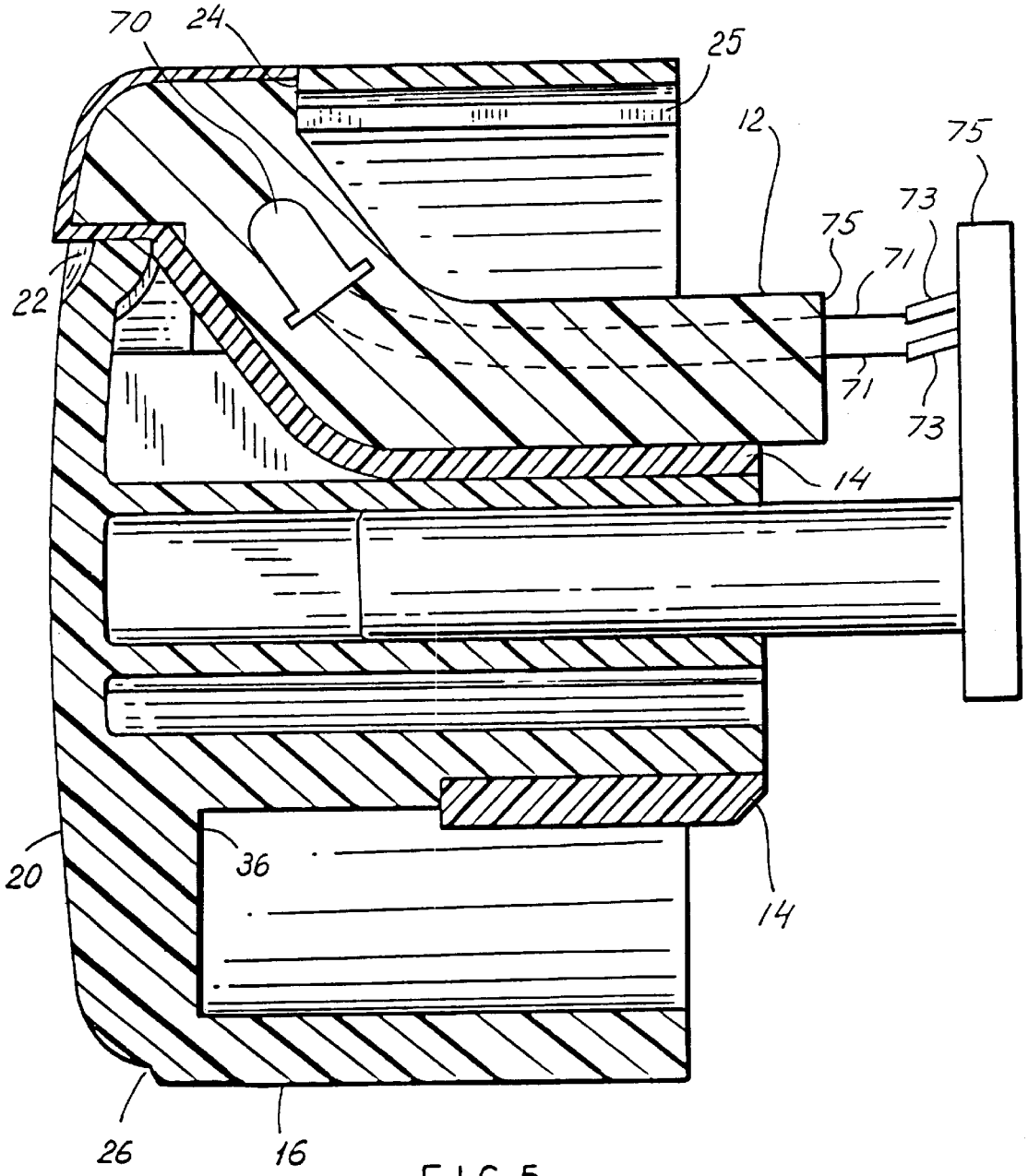
FIG. 5 is a side cross-sectional view of the control knob, assembled with the jewel LED holder assembly and jewel body collar assembly, of the first embodiment of the present invention.

As shown in FIGS. 2 and 5, control knob 10 further includes slightly convex front circular face 20 which includes slot 24 extending radially inwardly from the "twelve-o'clock" position, terminating in an indented spherical dimple 22. As further shown in FIGS. 1 and 2, slot 24 is further formed longitudinally along a portion of cylindrical shell 16 at the "twelve o'clock" position and through a portion in which an undulation 18 would otherwise be formed. The interior portion of cylindrical shell 16 at the "twelve o'clock position" (which includes slot 24) includes notch 25 formed by a reduction in thickness of cylindrical shell 16. Similarly, the interior portion of front circular face 20 at the "twelve o'clock position" (which includes slot 24) includes a reduction of thickness, as will be explained hereinafter, to provide a detent mechanism to engage jewel body collar assembly 14.

The outer circumferential edge of front circular face 20 is chamfered inwardly in order to present an edge 26 which is free of sharp surfaces and to present a clean aesthetic appearance.

Figure 3:
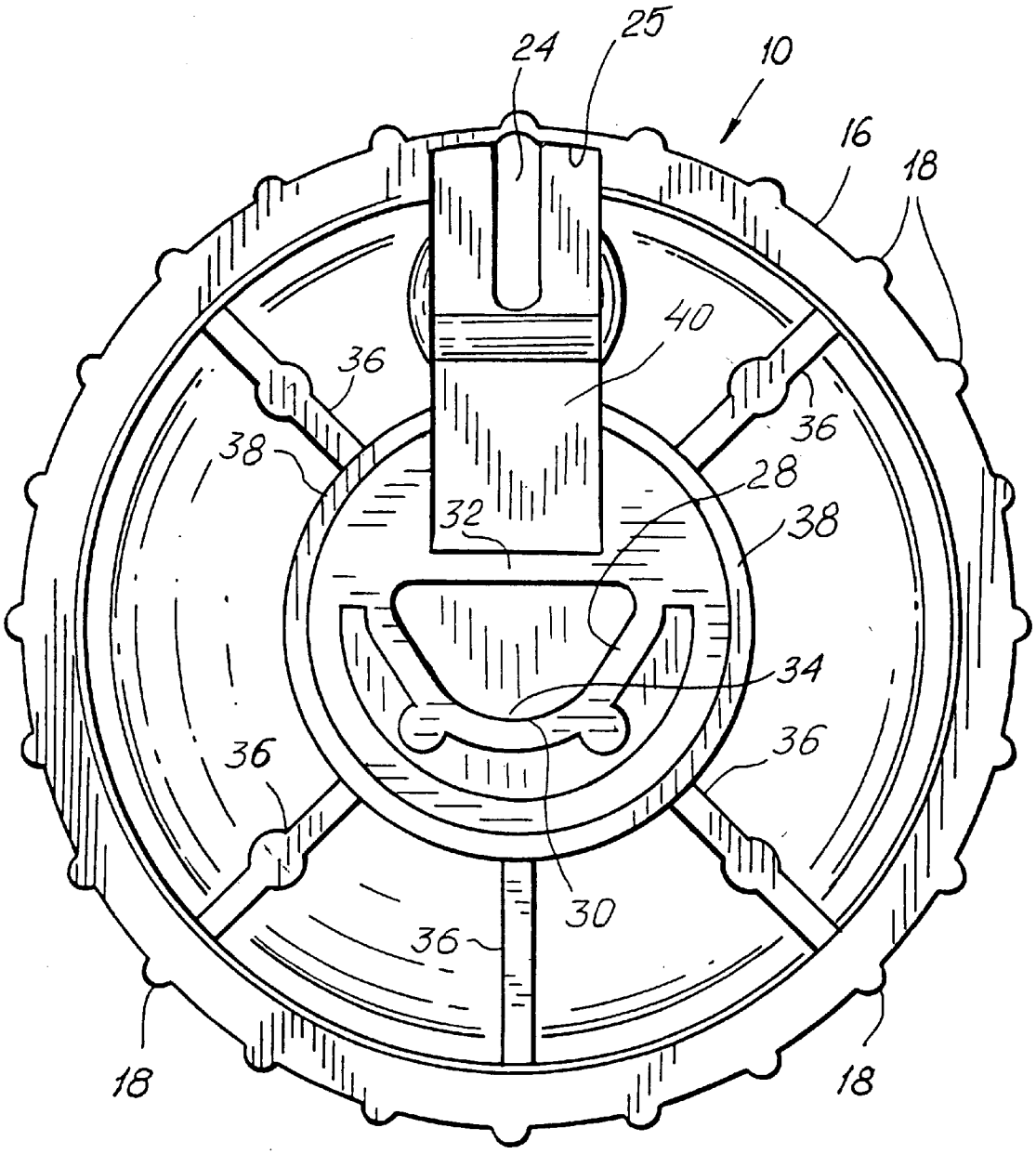
FIG. 3 is a rear plan view of the control knob of the first embodiment of the present invention.

As shown in FIGS. 3 and 5, the center of the rear control knob 10 includes a D-shaped aperture 28 comprised of a partially circular portion 30 and a flat portion 32 for engaging a carrier shaft 100 (shown in phantom in FIG. 1) of a similar cross section formed concentrically within cylindrical support portion 38 formed about the axis of rotation of knob 10.

Supporting ribs 36 extend from the interior of cylindrical shell 16 to the exterior of the walls forming D-shaped aperture 28.

Figure 4:
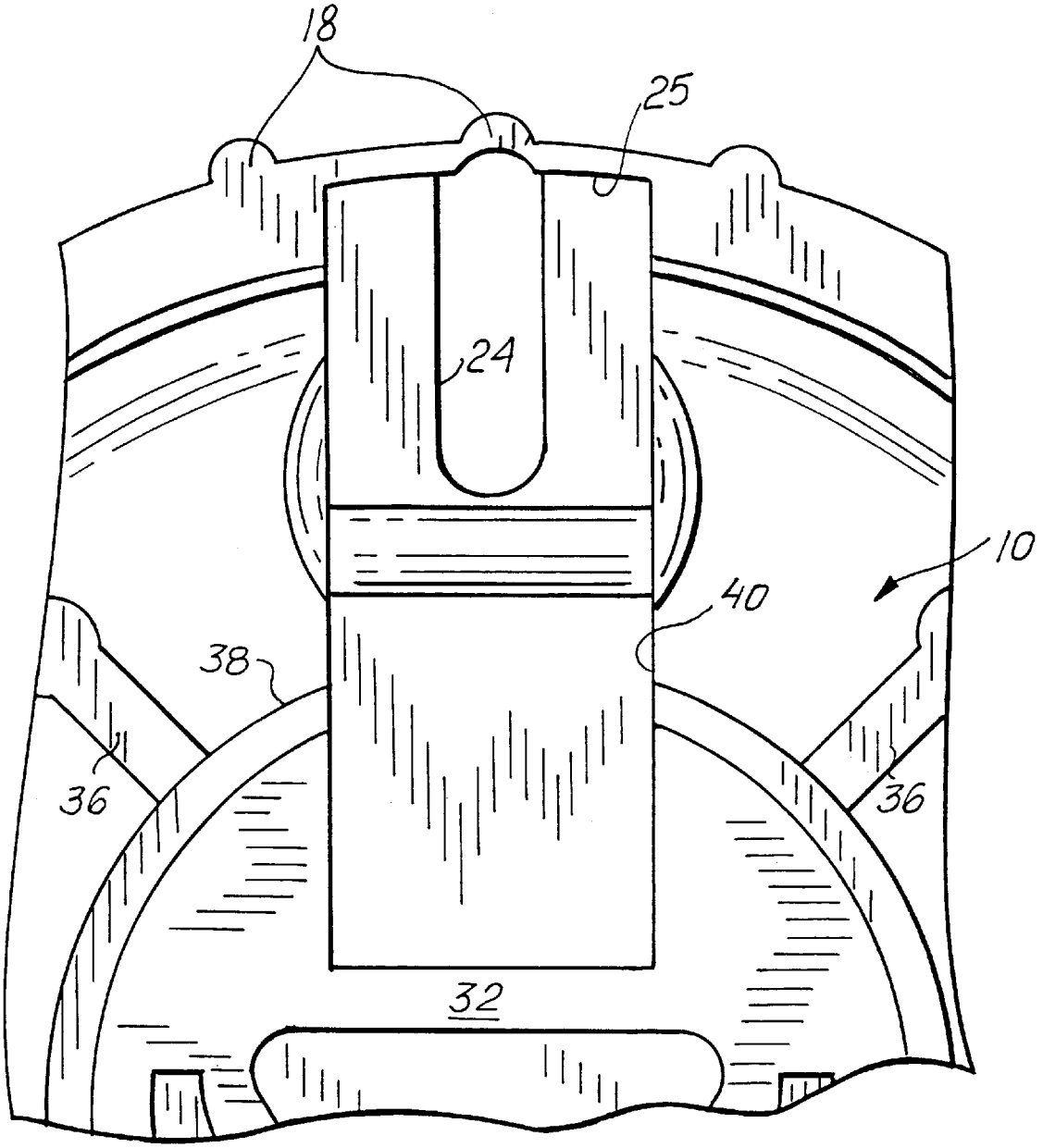
FIG. 4 is a rear view of the channel within the control knob into which the assembled jewel LED holder assembly and jewel body collar assembly fit.

As shown in FIG. 3 and more detail in FIG. 4, notch 40 is formed within cylindrical support portion 38 abutting flat portion 32, radially opposed from notch 25 on the interior of cylindrical shell 16 thereby forming a detent engagement for jewel body collar assembly 14.

While the jewel LED holder assembly 12 and jewel body collar assembly 14 are illustrated as separate elements, these elements could be formed together as one piece in an insert molding process.

Jewel body collar assembly 14 is illustrated in FIGS. 6*a*–6*e*. Jewel body collar assembly 14 includes a cylindrical collar 50 with a housing assembly 52 fixed along a portion of the circumference thereof. As shown in FIGS. 1 and 3, cylindrical collar 50 joins concentrically around cylindrical support section 38 of knob 10 so as to form a bearing surface against the mating bezel (not shown) thereby reducing or eliminating side-to-side wobble of knob 10 during use. Further, as the jewel body collar assembly 14 is typically made of a lubricated material, such as acetel, ease of rotation of knob 10 is improved.

Housing assembly 52 further presents angled surface 51 to add relief during assembly until jewel body collar assembly 14 locks into place in control knob 10. This locking or snap fit procedure is described in further detail hereinafter.

The proximal portion of housing assembly 52 extends inwardly radially from a circumference of cylindrical collar 50 to be engaged by notch 40 of cylindrical support portion 38 of knob 10, as shown in FIGS. 1, 3 and 4 while the distal portion of housing assembly 52 extends generally diagonally upwardly and outwardly to indicator element 53. Indicator element 53 includes interior grooved section 54 and exterior ridged section 55, further including horizontal section 56 and vertical section 57 (from the perspective of FIGS. 6*a* and 6*c*), both of which are intended to be visible from the exterior of knob 10. Horizontal section 56 of exterior ridged section 55 of indicator element 53 engages the portion of slot 24 on cylindrical shell 16 while vertical section 57 of exterior ridged section 55 of indicator element 53 engages the portion of slot 24 on front circular face 20 (see FIGS. 1 and 2).

Additionally, the proximal portion of housing assembly 52 includes blind longitudinal slots 60 for engaging jewel LED holder assembly 12.

Figure 7A:
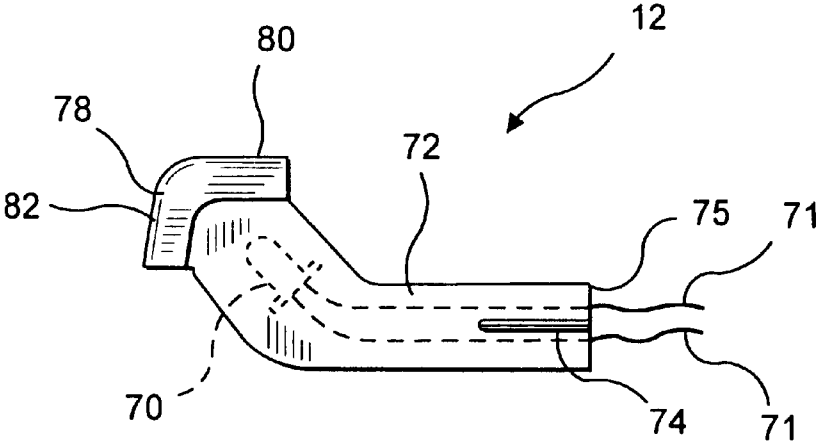
FIG. 7*a*, 7*b*, 7*c* and 7*d* are side, top, front and detailed side plan views, respectively, of the jewel LED holder assembly of the first embodiment of the present invention.
Figure 7C:
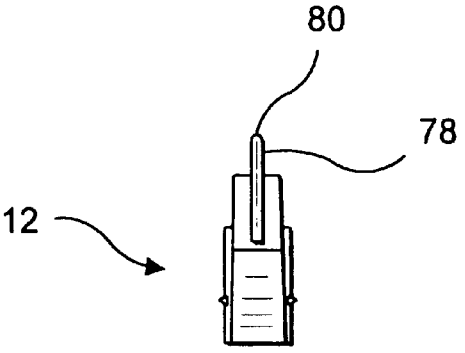
Figure 7B:
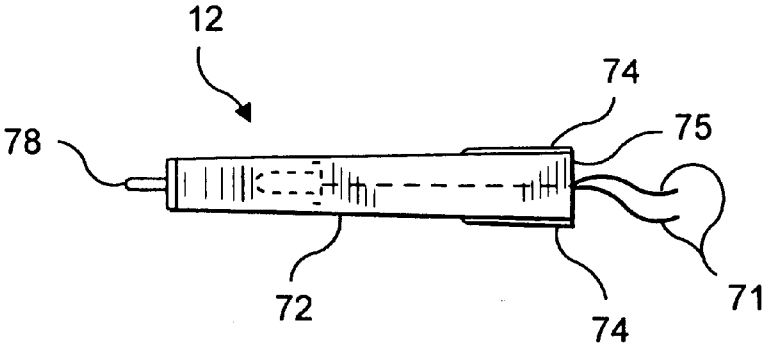
Figure 7D:
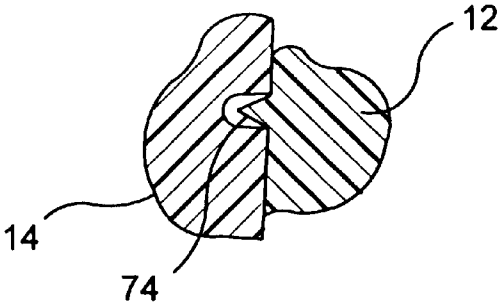

Jewel LED holder assembly 12 is shown in more detail in FIGS. 7*a*, 7*b*, 7*c* and 7*d*. Jewel LED holder assembly 12 includes embedded LED 70 as powered via leads 71 which extend from the rear 75 of jewel LED holder assembly 12. The lateral sides of jewel LED holder assembly 12 proximate to rear 75 further includes longitudinal protrusions 74 (a cross section of which is shown in FIG. 7d) which engage blind longitudinal slots 60 in jewel body collar assembly 14. The upper portion of body 72 includes indicator ridge 78 which includes horizontal ridge 80 and vertical ridge 82 (from the perspective of FIG. 7*a*). Horizontal ridge 80 of jewel LED holder assembly 12 engages horizontal section 56 of interior grooved section 54 of jewel body collar assembly 14. Likewise, vertical ridge 82 of jewel LED holder assembly 12 engages vertical section 57 of interior grooved section 54 of jewel body collar assembly 14 (see FIG. 1)

As shown in FIG. 5, leads 71 of LED 70 contact interconnect wipers 73 of polymer thick film (PTF) circuit 75. Leads 71 provide the current to LED 70. Additionally, the brightness and hue of LED 70 can be varied by varying the resistance and polarity. For example, the polymer thick film circuit 75 can be responsive to the degree of rotation of control shaft 100 and vary the brightness or hue of LED 70 in response to this degree of rotation. This, for example, could result in varying hue and/or brightness for different heater settings.

Jewel body collar assembly 14 is typically polycarbonate, such as acetel, translucent, and of a first color, typically white. Therefore, when jewel LED holder assembly 12 is not illuminated from LED 70 in jewel LED holder assembly 12, the jewel body collar assembly 14 appears to be white. Jewel LED holder assembly 12 is similarly translucent polycarbonate. The color of jewel LED holder assembly 12 in combination with the color of LED 70 (when illuminated, and which can vary in both hue and intensity) results in a second color, such as blue, blue-green or ice blue", which is projected through jewel body collar assembly 12 and is the color of the indicator of control knob 10 during nighttime.

Figure 8:
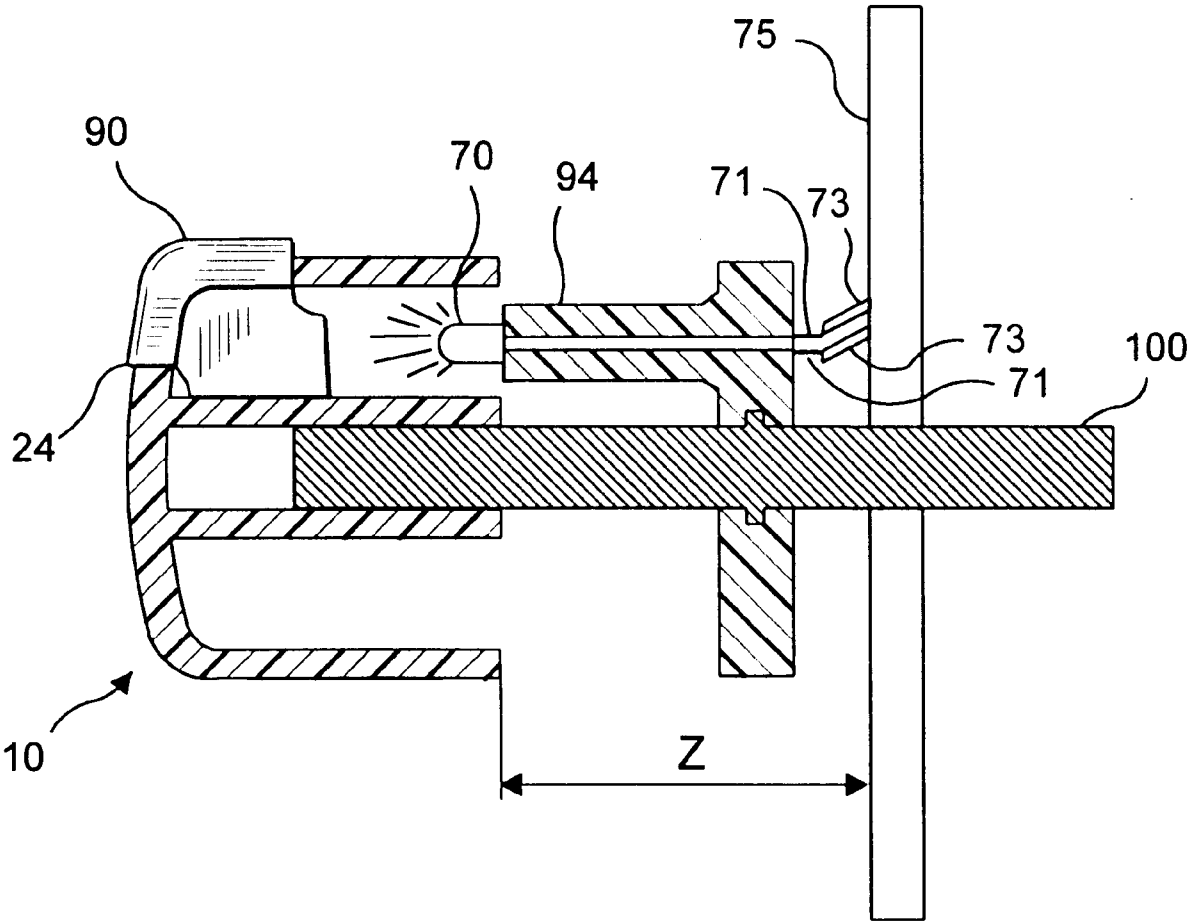
FIG. 8 is a side view, partly in cross section, of a second embodiment of the present invention, wherein the LED is secured to the control shaft.

FIG. 8 is a side cross-sectional view of an alternative embodiment of control knob 10. Jewel indicator 90 is a single piece of polycarbonate of a first color, such as white, and forms the indicator through slot 24 of control knob 10. Jewel indicator 90 further functions to collect light emitted from LED 70 which is secured to LED mount 94 which is parallel to control shaft 100. LED mount 94 further is secured to LED mount collar 92 which is engaged to control shaft 100 and rotates in concert therewith. Leads 71 of LED 70 pass through LED mount 94 and LED mount collar 92 to contact interconnect wipers 73 of polymer thick film circuit 75. This results in a structure wherein the polymer thick film circuit 75 can be offset from control knob 10 and further results in a simplified construction of control knob 10.

To install the first embodiment of control knob 10, jewel LED holder assembly 12 and jewel body collar assembly 14 of the first embodiment of the present invention, the user inserts jewel LED holder assembly 12 into jewel body collar assembly so that longitudinal protrusions 74 of jewel LED holder assembly 12 engage blind longitudinal slots 60 in jewel body collar assembly 14 and further so that horizontal ridge 80 of jewel LED holder assembly 12 engages horizontal section 56 of interior grooved section 54 of jewel body collar assembly 14 and vertical ridge 82 of jewel LED holder assembly 12 engages vertical section 57 of interior grooved section 54 of jewel body collar assembly 14. The user then inserts the jewel LED holder assembly 12 and jewel body collar assembly 14 so that cylindrical collar 50 of jewel body collar assembly 14 outwardly concentrically engages support section 38 of knob 10 so as to form a bearing surface against the mating bezel (not shown). Additionally, proximal portion of housing assembly 52 which extends inwardly radially from a circumference of cylindrical collar 50 is engaged by notch 40 of cylindrical support portion 38 of knob 10. Horizontal section 56 of exterior ridged section 55 of indicator element 53 of jewel body collar assembly 14 engages the portion of slot 24 on cylindrical shell 16 while vertical section 57 of exterior ridged section 55 of indicator element 53 of jewel body collar assembly 14 engages the portion of slot 24 on front circular face 20. Distal portion of housing assembly 52 of jewel body collar assembly 14 engages notch 25 of cylindrical shell 16 and likewise engages a similar reduction of thickness on the interior of front circular face 20. These engagements provide for a snap-fit ease of assembly.

Finally, control knob 10 is inserted on control shaft 100 so that leads 71 of LED 70 contact interconnect wipers 73.

The order of assembly of the above elements can be varied.

To install the second embodiment of control knob 10, jewel indicator 90 is secured within control knob 10 and control knob 10 is inserted onto control shaft 100 so that leads 71 contact interconnect wipers 73.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A control knob comprising:

a front face bounded by a cylindrical sidewall, a slot in at least one of said cylindrical sidewall and said front face;

an indicator assembly including a ridge extending through said slot, at least said ridge being of a first color, at least a portion of said indicator assembly being translucent;

a mount assembly including an LED, said mount assembly being adapted so that when said LED is illuminated, said LED projects light of a second color, different from said first color, through said indicator assembly, said LED being rotatable in concert with a rotation of said control knob, at least one of intensity and hue of said second color from said LED being variable in accordance with a degree of rotation of said LED and said control knob; and an associated control circuit;

wherein said LED includes electrical leads which pass through said mount assembly and contact interconnect wipers of said associated control circuit.

2. The control knob of claim 1 wherein said control circuit is a polymer thick film circuit.

3. The control knob of claim 2 further including a support element formed about an axis of rotation of the control knob, said support element engaging a control shaft.

4. The control knob of claim 3 wherein said associated control circuit is responsive to rotation of said control shaft.

5. The control knob of claim 4 wherein said indicator assembly includes a collar for engaging said support element and wherein said indicator assembly includes a housing assembly for housing said mount assembly.

6. The control knob of claim 5 wherein said mount assembly is translucent and said LED is embedded within said mount assembly.

7. The control knob of claim 4 wherein said mount assembly is separate from said indicator assembly.

8. The control knob of claim 7 wherein said mount assembly includes a collar which engages said control shaft and wherein said mount assembly, said collar and said control shaft rotate in concert with the control knob.

* * * * *